US011078791B2

(12) United States Patent
Liu et al.

(10) Patent No.: US 11,078,791 B2
(45) Date of Patent: Aug. 3, 2021

(54) GROUTING BOLT-CABLE COMPOSITE BEAM AND SUPPORTING METHOD FOR ADVANCED SUPPORT OF FRACTURED SURROUNDING ROCK IN DEEP COAL MINES

(71) Applicant: SHANDONG UNIVERSITY OF SCIENCE AND TECHNOLOGY, Qingdao (CN)

(72) Inventors: Xuesheng Liu, Qingdao (CN); Deyuan Fan, Qingdao (CN); Yunliang Tan, Qingdao (CN); Kang Yang, Qingdao (CN); Shilin Song, Qingdao (CN); Yunhao Wu, Qingdao (CN); Xuebin Li, Qingdao (CN); Xin Wang, Qingdao (CN)

(73) Assignee: SHANDONG UNIVERSITY OF SCIENCE AND TECHNOLOGY, Jinan (CN)

( * ) Notice: Subject to any disclaimer, the term of this patent is extended or adjusted under 35 U.S.C. 154(b) by 0 days.

(21) Appl. No.: 17/110,412

(22) Filed: Dec. 3, 2020

(65) Prior Publication Data

US 2021/0087931 A1 Mar. 25, 2021

(51) Int. Cl.
*E21D 21/00* (2006.01)
*E21D 20/02* (2006.01)

(52) U.S. Cl.
CPC ..... *E21D 21/008* (2013.01); *E21D 20/02* (2013.01); *E21D 21/0086* (2013.01); *E21D 21/0093* (2013.01)

(58) Field of Classification Search
CPC ..... E21D 21/0086
USPC ..... 405/302.1, 302.2
See application file for complete search history.

(56) References Cited

U.S. PATENT DOCUMENTS 4,456,405 A * 6/1984 Galis ..... E21D 11/006 405/259.1
4,601,616 A * 7/1986 Barish ..... E21D 11/006 405/288
5,018,907 A * 5/1991 Chugh ..... E21D 11/006 405/259.3
5,385,433 A * 1/1995 Calandra, Jr. ..... E21D 11/006 405/259.1
5,466,095 A * 11/1995 Scott ..... E21D 11/006 405/259.1

FOREIGN PATENT DOCUMENTS

FR 1521519 A * 4/1968

* cited by examiner

*Primary Examiner* — Sunil Singh
(74) *Attorney, Agent, or Firm* — CBM Patent Consulting, LLC

(57) ABSTRACT

It discloses a grouting bolt-cable composite beam and supporting method for advanced support of fractured surrounding rock in deep coal mines. The quadrate plates are fixed at both ends of the steel beam, the anchor cable holes are arranged in the center of the steel beam and the quadrate plates, and the diameter of anchor bolt holes should be larger than that of the grouting cables. There are four anchor bolt holes on each quadrate plate, and each anchor bolt hole corresponds to a anchor plate, the horizontal surface of the anchor plate is close to the quadrate plate, and the arc parts of the four anchor plates are all facing the center of the quadrate plate.

4 Claims, 6 Drawing Sheets

GROUTING BOLT-CABLE COMPOSITE BEAM AND SUPPORTING METHOD FOR ADVANCED SUPPORT OF FRACTURED SURROUNDING ROCK IN DEEP COAL MINES

This application claims priority to Chinese Patent Application Ser. No. CN202011101589.6 filed on 15 Oct. 2020.

TECHNICAL FIELD

The invention belongs to the field of supporting technology of mining engineering, and in particular to a grouting bolt-cable composite beam and supporting method for advanced support of fractured surrounding rock in deep coal mines.

TECHNICAL BACKGROUND

At present, coal resources account for about 60% of China's primary energy consumption, and underground mining accounts for about 90% of coal resource production. In the process of underground mining, a large number of roadways need to be excavated every year. And support of roadway is generally divided into two stages: permanent support in the excavation and advance support in the preparation. The advanced support of working face is the key and difficult point to restrict the safe and efficient production of coal mine, especially for the condition of deep fractured surrounding rock. Due to the double influence of high ground stress and repeated mining disturbance, the mechanical characteristics and engineering response of coal and rock mass become extremely complex, and roof-falling and rib-spalling are easy to occur in the advanced section.

The traditional advanced support methods in China mainly include: individual prop+articulated top-girder support, and hydraulic support. Among them, individual prop+articulated top-girder support belongs to passive support. Although it can realize the control and maintenance of roof for small and medium section roadway, there are also some shortcomings such as small roof protection area, low support strength, high labor intensity, high initial investment, poor roof adaptability and low safety. In addition, hydraulic support also belongs to passive support. Compared with individual prop support, it has stronger support strength, more mechanized and better dynamic yielding characteristics. It plays an important role in reducing labor intensity, decreasing safety risks and improving work efficiency. However, the repeated movement of hydraulic support will aggravate the roof deformation and failure, especially in the weak and fracture condition, which is not conducive to roof control and maintenance.

In order to solve the problems above, there is a hybrid advanced support method for small section roadway (Patent No. 201910917514.6). This method adopts the advanced support of individual prop+grouting cable, which improves the support strength and increases the working space to a certain extent. However, this method still uses individual prop for advanced support. For the weak and fractured roof condition, it is difficult to support and withdraw the prop. And it is easy to cause the column incline and slide, leading to the failure of the advanced support.

In the existing technology, there is also a kind of advanced support system and method for working face (Patent No. 201811237479.5). This method adopts the support mode of truss+grouting cable, which effectively improves the support strength, and has the advantages of low cost and convenient construction. However, this method does not give a clear grouting construction time and measures, which can not guarantee the slurry diffusion range. What is more, the truss spacing is determined according to the empirical value, which can not achieve accurate construction. In addition, although the cable truss has the characteristics of good coordination ability and large support span, its deformation capacity is poor and bearing capacity is limited, which can not effectively control the roof deformation and failure.

In the existing technology, there is also an advanced support method of grouting cable (Patent No. 201811583423.5). This method adopts grouting cable for advanced support, which significantly improves the support strength and construction speed, and realizes the actively reinforcement. However, this method does not distinguish the grouting area, which is easy to cause the slurry waste and construction blindness. In addition, linear combination reinforcement arch structure can be formed by alternate arrangement of bolt and grouting cable, but the slurry is difficult to diffuse, and the scope of grouting reinforcement area is small, which can not guarantee the supporting effect.

In the existing technology, there is also a method to determine the best grouting time in the laboratory (Patent No. 201810225980.3). This method uses biaxial rheology and grouting coupling test to obtain the change between the internal cracks development and the strength of grouting consolidation, and then determines the optimal grouting time. However, this method is only limited to the indoor test under ideal conditions, and can not effectively guide the field grouting construction. In addition, the method only considers the diffusion of grouting slurry in the internal cracks of rock, and fails to simulate the reinforcement and support effect of anchor or cable.

In addition, the anchor plates used in the above technologies are traditional plates. Although the plates with this structure is suitable for any inclined borehole in theory, it is found in practical application that when the inclinations are large and inconsistent, some bolt fastening nuts and plates can not be installed. In addition, when multiple bolts with different inclinations are set in an area, it will cause difficulties in plates installation and overlap with each other.

Therefore, the prior technologies need further improvement and development.

INVENTION CONTENTS

In view of the shortcomings of the prior technologies, we intend to provide a anchor plate for inclined borehole, a grouting bolt-cable composite beam and supporting method for advanced support of fractured surrounding rock in deep coal mines, so as to keep the roadway intact and stable under the advanced abutment pressure.

The object of the invention can be realized by the following technical solutions:

The anchor plate for inclined borehole is a wedge-shaped block, whose upper and lower surfaces are horizontal and inclined planes respectively with anchor bolt hole arranged in the middle. And the angle of wedge-shaped block should ensure that the bolt is perpendicular to the inclined plane.

Furtherly, the wedge-shaped tip of anchor plate is concave arc-shaped.

A grouting bolt-cable composite beam for advanced support of fractured surrounding rock in deep coal mines, which includes steel beam, grouting cable, grouting bolt, quadrate plate, anchor plate, fastening nut and anchor rigging. The connection relationship of the above components is as follows:

The quadrate plates are fixed at both ends of the steel beam, the anchor cable holes are arranged in the center of the steel beam and the quadrate plates, and the diameter of anchor bolt holes should be larger than that of the grouting cables. There are four anchor bolt holes on each quadrate plate, and each anchor bolt hole corresponds to a anchor plate, the horizontal surface of the anchor plate is close to the quadrate plate, and the arc parts of the four anchor plates are all facing the center of the quadrate plate. The grouting bolt passes through the anchor plate and quadrate plate in turn, and is fixed in the roof by the anchoring agent, and the free end of the bolt is applied with pretension through the fastening nut. Besides, the grouting cable passes through the anchor cable hole and is fixed in the overlying stable rock stratum by the anchoring agent, and the free end of the cable is fixed by the anchor rigging.

Furtherly, the anchor bolt hole on the quadrate plate is a long round hole in order to adapt to the boreholes with different inclinations. And the diameters of long round holes should be larger than that of the grouting bolts, so that the bolts can move in the long round holes to adapt to the angle changes of borehole. Meanwhile, it can improve the fault tolerance rate in the drilling construction process.

The inclined angle of the anchor plate is customized according to the specific site conditions and requirements. In actual operation, the anchor plate can be made into a standard set according to the angle in advance. When used in the field, the anchor plate with corresponding angle is selected according to the specific conditions.

The grouting bolt-cable composite beam is mainly applicable to the roof conditions with large faults and a large number of rock fragments. In practice, selective grouting can be carried out according to the development degree of cracks in the roof. When the internal cracks of the roof are relatively developed and connected with each other, the number of bolt-grouting is 6-8. When the roof is complete and stable, and there are only a few tiny cracks and joints, the bolt-grouting number is 0-3.

The grouting bolt-cable composite beam supporting method for advanced support of fractured surrounding rock in deep coal mines is as follows:

S1: The Stress Relief Method is Used to Monitor the Advance Abutment Pressure of Working Face With the working face advanced, the roof behind the working face gradually collapses and becomes goaf. Several boreholes are arranged in the roadway along the coal seam strike within a certain range in the advanced working face. The relative change of surrounding rock stress is obtained by using borehole stressmeter, and then the distribution characteristics of advance abutment pressure are analyzed and the stress curve is drawn. According to the stress curve, the influence range can be determined.

S2: Borehole Imaging Method is Used to Detect the Roadway Roof

S2.1: Several boreholes are arranged at the roof along the coal seam strike within the influence range of the advance abutment pressure. The fracture detection is carried out by using the borehole imaging method to obtain the height, range and damage degree of the roof fracture. According to the detection result, the borehole angle can be determined. Then, the matching anchor plate is selected based on the borehole angle.

S2.2: Taking the midpoint of the borehole axis as the dividing line, the range from the orifice to the midpoint is defined as the shallow part, and the range from the midpoint to the bottom of the borehole is defined as the deep part. The S2.1 borehole imaging results were analyzed, including the number of fractures and the fracture opening degree. And the area between the first borehole with cracks in the shallow part and the first one in the deep part affected by the advanced abutment pressure is defined as the shallow grouting zone. Similarly, the area between the first deep fracture borehole and the borehole closest to the peak stress is defined as the deep grouting zone.

S3: Reinforcement and Support Design for Roadway Beyond the Range of Advance Abutment Pressure

S3.1: Row Spacing P of Composite Beam Determination

The maximum diffusion range K of grouting slurry of the composite beam in the surrounding rock is:

$$K=R+S$$

Where R is the slurry diffusion radius when the grouting bolt is vertically arranged, the unit is m; S is the slurry diffusion range when the grouting bolt is inclined, the unit is m.

When the grouting anchor bolt is vertically arranged, the slurry diffusion radius R is:

$$R=\sqrt{\frac{QT}{\pi HN}}$$

Where Q is grouting amount per unit time, the unit is $m^3$/min; T is the grouting duration, the unit is min; N is the porosity of rock stratum, which can be obtained by indoor rock mechanics test; H is the thickness of the rock injected with slurry, the unit is m.

The thickness H of the rock injected with slurry can be determined as:

$$H=L\cdot\sin\theta$$

Where L is the length of grouting bolt, the unit is m; θ is the inclination of grouting bolt in the surrounding rock, $\theta=90°-\alpha$, and a is the inclination of anchor plate, the unit is °;

When the grouting bolt is inclined, the slurry diffusion range S is:

$$S=R+\sqrt{L^2-H^2}$$

The row spacing P of composite beam should meet the following requirements:

$$P\leq 2S\cdot\cos\beta,$$

Where β is the downward inclination of grouting bolt in surrounding rock, the unit is °.

S3.2: The grouting bolt-cable composite beam is arranged according to the row spacing P beyond the range of advance abutment pressure. In this process, the grouting bolt and grouting cable are pretensioned, but the grouting construction is not carried out, so as to realize the preliminary support and reinforcement of the roadway.

S4: Grouting Construction of Shallow Grouting Zone

Within the influence range of advance abutment pressure, the surrounding rock of roadway is gradually damaged from shallow to deep. According to the detection results of roof fracture zone, the selective grouting construction is carried out to the grouting bolts entering the shallow grouting zone, so as to realize the reinforcement of the shallow surrounding rock of roadway.

S5: Grouting Construction of Deep Grouting Zone

As the working face continues to advance, grouting construction is carried out for the grouting cable entering the deep grouting zone, and the grouting construction is carried out for the grouting bolt entering the shallow grouting zone, so as to achieve the progressive reinforcement of the surrounding rock from shallow to deep, from the surface to the inside.

Every time the working face completes a cycle footage, repeat the above S1-S5.

The grouting construction in the above steps should be started in the maintenance team and completed as soon as possible to provide stable surrounding rock environment for the solidification of grouting materials.

The grouting bolt and grouting cable adopt the full-length anchoring form.

The advantages of this invention lie in:

(1) A grouting bolt-cable composite beam for advanced support of fractured surrounding rock in deep coal mines, which adopts the combination of quadrate plate and steel beam. It overcomes the defect of traditional steel band which is easy to shear failure, and increases the roof protection area. At the same time, it cancels the traditional anchor plates, fundamentally avoids the support structure failure caused by the plate pressing into the steel band. The composite beam is close to the roof and has strong bearing capacity and roof control ability.

(2) The grouting cable advanced support not only has the characteristics of large anchorage depth, high bearing capacity and high pretensionable. At the same time, the slurry diffusion area of grouting bolt is determined according to the borehole angle, and the precise row spacing of composite beam is further obtained. The fractured surrounding rock can be cemented as a whole and firmly fixed in the overlying stable rock stratum, so as to avoid the impact caused by separation. In addition, bolt-grouting of different angles can be realized by combination of quadrate plate and anchor plate. It is conducive to controlling the development of plastic zone, actively repairing the damage, greatly improving the integrity and self-bearing capacity of surrounding rock, improving the stress state and maintaining the stability of roadway.

(3) The division of grouting area can be obtained by distribution curve of advance abutment pressure through stress relief method, and cracks development before the peak value of advance abutment pressure through borehole imaging method. By means of in-site monitoring, the timing and sequence of grouting construction are defined, the blindness in construction is averted, the grouting effect is guaranteed, the waste of grouting slurry is avoided, the labor intensity of workers is reduced, and the production safety is improved.

(4) Through the grouting construction in the shallow and the deep area in turn, the surrounding rock of roadway can be progressive reinforced step by step from the shallow to the deep, from the surface to the inside. It is conducive to the control and maintenance for the roadway under the conditions of weak and fractured roof.

(5) This invention changes the traditional anchor plate into the wedge-shaped block, which can not only be suitable for borehole at any angle, but also calculate the grouting diffusion range, so as to accurately obtain the construction row spacing of the composite beam. Besides, it can avoid the loopholes in the process of anchoring construction and realize accurate support.

DESCRIPTION OF FIGURES

In order to illustrate the implementation of the invention or the prior technology more clearly, the figures used in the invention will be briefly described below.

In the figures: 1—quadrate plate, 2—anchor plate, 3—steel beam, 4—anchor cable hole, 5—anchor bolt hole, 6—grouting bolt, 7—grouting cable, 8—roadway, 9—fastening nut, 10—anchor rigging, 11—working face, 12—goaf, 13—advanced abutment pressure zone, 131—shallow grouting zone, 132—deep grouting zone, 14—initial stress zone, 141—no-grouting zone, 15—distribution curve of advance abutment pressure, 16—bolt-grouting range, 17—cable-grouting range.

Detail Implementation Method

The preferred implementation detail of the invention is described based on the figures, to make the advantages and features of the invention easier to be understood by those skilled in the field. Thus, the protections cope of the invention can be defined more clearly.

Figure 1:
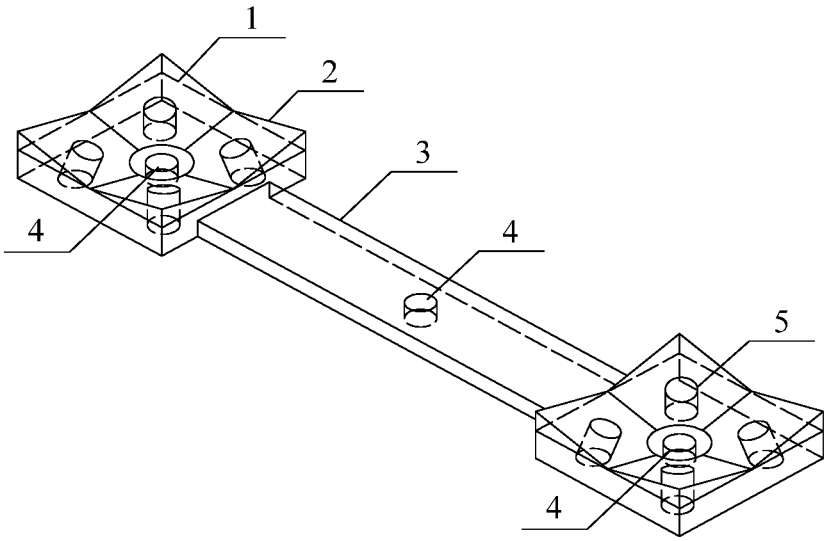
FIG. 1 is a structural schematic of the grouting bolt-cable composite beam for advanced support of fractured surrounding rock in deep coal mines.
Figure 2:
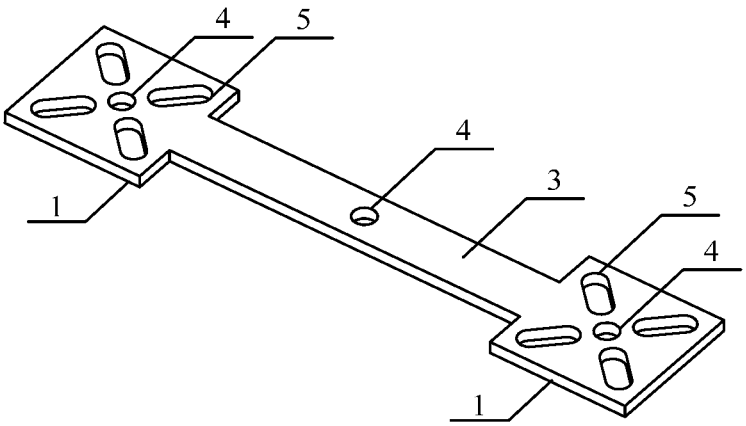
FIG. 2 is a structural schematic of quadrate plate and steel beam of the grouting bolt-cable composite beam for advanced support of fractured surrounding rock in deep coal mines.
Figure 3:
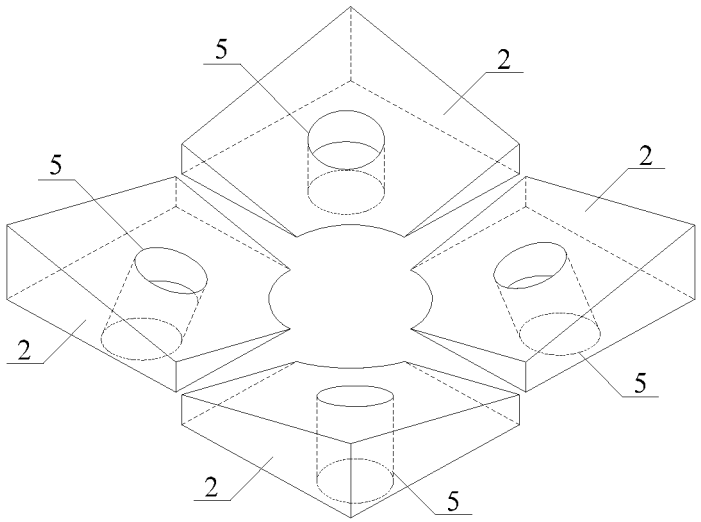
FIG. 3 is a structural schematic of anchor plate of the grouting bolt-cable composite beam for advanced support of fractured surrounding rock in deep coal mines.
Figure 4:
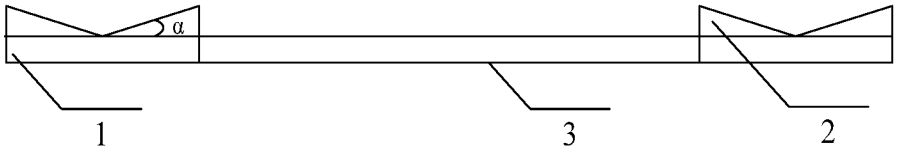
FIG. 4 is the elevation view of the grouting bolt-cable composite beam for advanced support of fractured surrounding rock in deep coal mines.
Figure 5:
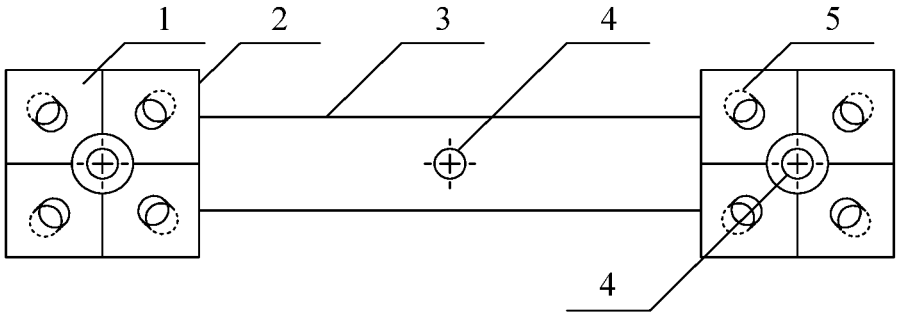
FIG. 5 is the upward view of the grouting bolt-cable composite beam for advanced support of fractured surrounding rock in deep coal mines.
Figure 6:
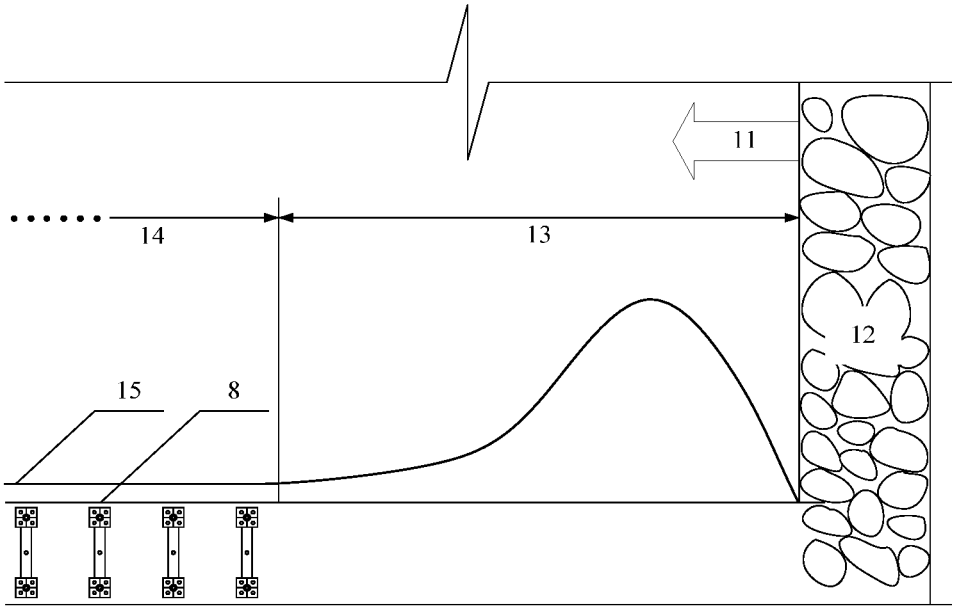
FIG. 6 is a structural schematic of S3 of the grouting bolt-cable composite beam for advanced support of fractured surrounding rock in deep coal mines.

The anchor plate 2 used in the composite beam is shown in FIG. 3, which shows the state of four anchor plates 2 arranged on the quadrate plate 1. As shown in the figure, the anchor plate 2 is the wedge-shaped block, whose upper and lower surfaces are horizontal and inclined planes respectively with anchor bolt hole 5 arranged in the middle. The angle of wedge-shaped block should ensure that the grouting bolt 6 is perpendicular to the inclined plane of anchor plate 2, that is to say, the anchor bolt hole 5 is perpendicular to the anchor plate 2. The tip of wedge-shaped block is concave arc-shaped to avoid affecting the installation of the grouting cable 7 in the center of the quadrate plate 1.

The grouting bolt-cable composite beam for advanced support of fractured surrounding rock in deep coal mines, as shown in FIG. 1-5. It includes steel beam 3, grouting cable 7, grouting bolt 6, quadrate plate 1, anchor plate 2, fastening nut 9 and anchor rigging 10. The quadrate plates 1 are welded and fixed at both ends of the steel beam 3, the anchor cable holes 4 are arranged in the center of the steel beam 3 and the quadrate plates 1, and the diameter of anchor cable holes 4 should be larger than that of the grouting cables 7. There are four anchor bolt holes 5 on each quadrate plate 1, the horizontal surface of the anchor plate 2 is close to the quadrate plate 1, and the arc parts of the four anchor plates 2 are all facing the center of the quadrate plate 1. The grouting bolt passes through the anchor plate 2 and quadrate plate 1 in turn, and is fixed in the roof by the anchoring agent, and the free end of the grouting bolt 6 is applied with pretension through the fastening nut 9. Besides, The grouting cable 7 passes through the anchor cable hole 4 and is fixed in the overlying stable rock stratum by the anchoring agent, and the free end of the grouting cable 7 is fixed by the anchor rigging 10.

The anchor bolt hole 5 on the quadrate plate 1 is the long round hole in order to adapt to the boreholes with different inclinations. And the diameters of long round holes should be larger than that of the grouting bolts 6, so that the bolts can move in the long round holes to adapt to the angle changes of borehole. Meanwhile, it can improve the fault tolerance rate in the drilling construction process.

In the FIG. 6-12, the grouting bolt-cable composite beam supporting method for advanced support of fractured surrounding rock in deep coal mines is as follows:

S1. The Stress Relief Method is Used to Monitor the Advance Abutment Pressure of Working Face With the working face 11 advanced, the roof behind the working face gradually collapses and becomes goaf 12. Several boreholes are arranged in the roadway 8 along the coal seam strike within a certain range in the advanced working face (It is generally about 20 m). The relative change of surrounding rock stress is obtained by using borehole stressmeter, and then the distribution characteristics of advance abutment pressure are analyzed and the distribution curve of advance abutment pressure 15 is drawn, which is the advanced abutment pressure zone 13 shown in the figure.

S2. Borehole Imaging Method is Used to Detect the Roadway Roof

S2.1. Several boreholes are arranged at the roof along the coal seam strike within the advance abutment pressure zone 13. The fracture detection is carried out by using the borehole imaging method to obtain the height, range and damage degree of the roof fracture. According to the detection result, the borehole angle can be determined. Then, the matching anchor plate is selected based on the borehole angle.

Figure 7:
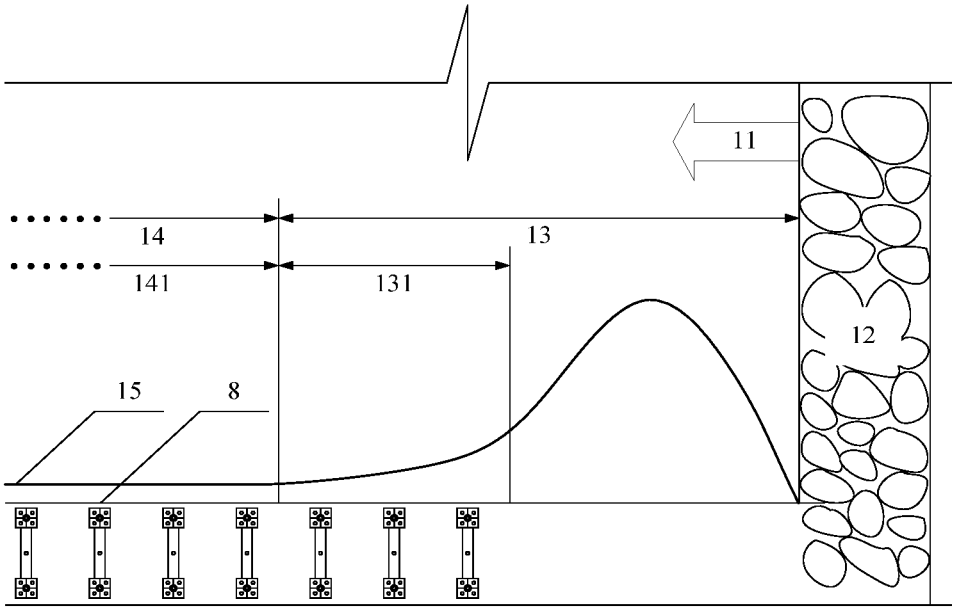
FIG. 7 is a structural schematic of S4 of the grouting bolt-cable composite beam for advanced support of fractured surrounding rock in deep coal mines.
Figure 8:
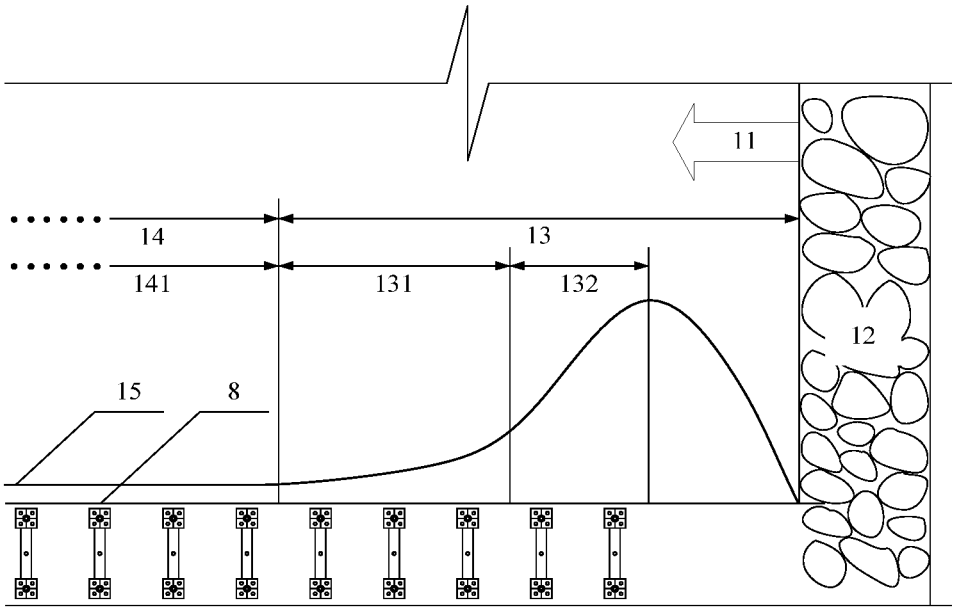
FIG. 8 is a structural schematic of S5 of the grouting bolt-cable composite beam for advanced support of fractured surrounding rock in deep coal mines.
Figure 9:
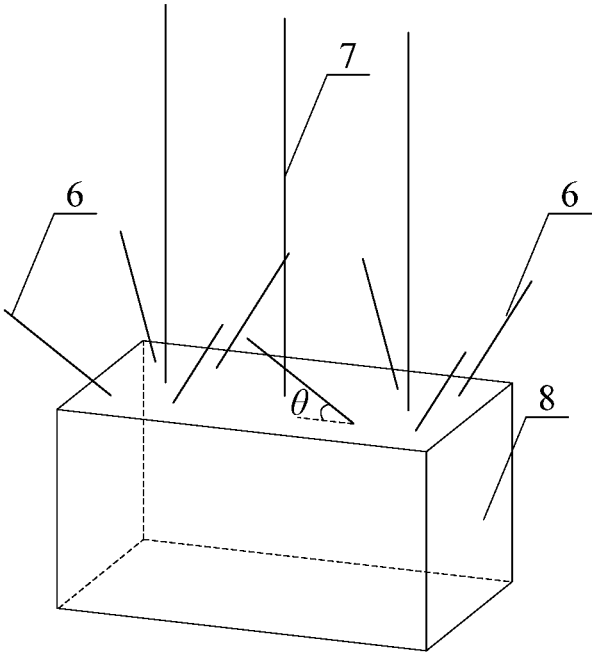
FIG. 9 is the supporting effect of the grouting bolt-cable composite beam for advanced support of fractured surrounding rock in deep coal mines.
Figure 10:
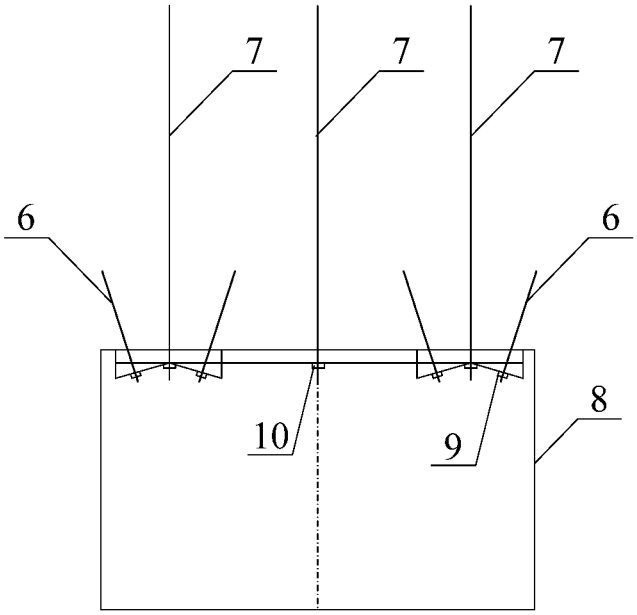
FIG. 10 is the supporting profile of the grouting bolt-cable composite beam for advanced support of fractured surrounding rock in deep coal mines.

S2.2. Taking the midpoint of the borehole axis as the dividing line, the range from the orifice to the midpoint is defined as the shallow part, and the range from the midpoint to the bottom of the borehole is defined as the deep part. The S2.1 borehole imaging results were analyzed, including the number of fractures and the fracture opening degree. And the area between the first borehole with cracks in the shallow part and the first one in the deep part affected by the advanced abutment pressure is defined as the shallow grouting zone 131, as shown in FIG. 7 and FIG. 8. Similarly, the area between the first deep fracture borehole and the borehole closest to the peak stress is defined as the deep grouting zone 132, as shown in FIG. 8.

Figure 11:
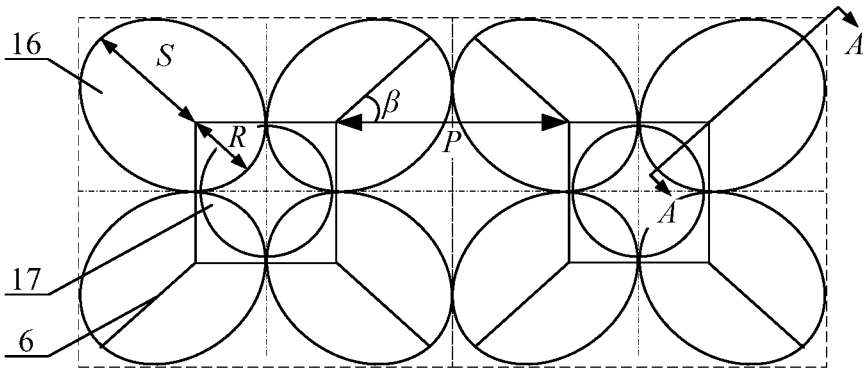
FIG. 11 is the top view of grouting slurry diffusion of the grouting bolt-cable composite beam for advanced support of fractured surrounding rock in deep coal mines.
Figure 12:
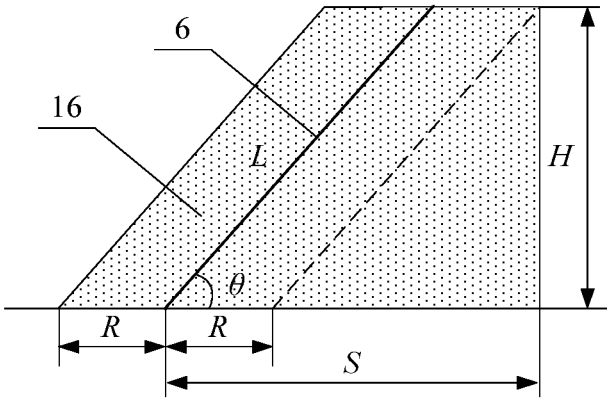
FIG. 12 is the profile of grout diffusion in surrounding rock of grouting bolt along A-A direction.

S3. Reinforcement and Support Design for Roadway Beyond the Range of Advance Abutment Pressure S3.1. Row Spacing P of Composite Beam Determination As shown in FIG. 11-12, the maximum diffusion range K of grouting slurry of the grout bolit 6 in the surrounding rock is:

$$K=R+S$$

Where R is the slurry diffusion radius when the grouting bolt 6 is vertically arranged, the unit is m; S is the slurry diffusion range when the grouting bolt is inclined, the unit is m.

When the grouting anchor bolt 6 is vertically arranged, the slurry diffusion radius R is:

$$R=\sqrt{\frac{QT}{\pi HN}}$$

Where Q is grouting amount per unit time, the unit is $m^3$/min; T is the grouting duration, the unit is min; N is the porosity of rock stratum, which can be obtained by indoor rock mechanics test; H is the thickness of the rock injected with slurry, the unit is m.

The thickness H of the rock injected with slurry can be determined in FIG. 12 as:

$$H=L\cdot\sin\theta$$

Where L is the length of grouting bolt 6, the unit is m; θ is the inclination of grouting bolt 6 in the surrounding rock, $\theta=90°-\alpha$, and a is the inclination of anchor plate 2, the unit is °.

When the grouting bolt 6 is inclined, the slurry diffusion range S is:

$$S=R+\sqrt{L^2-H^2}$$

The row spacing P of composite beam should meet the following requirements:

$$P\leq 2S\cdot\cos\beta,$$

Where β is the downward inclination of grouting bolt 6 in surrounding rock, the unit is °.

S3.2. The grouting bolt-cable composite beam is arranged according to the row spacing P beyond the advanced abutment pressure zone 13 (initial stress zone 14). In this process, the grouting bolt 6 and grouting cable 7 are pretensioned, but the grouting construction is not carried out (no-grouting zone 141 in FIG. 7), so as to realize the preliminary support and reinforcement of the roadway 8.

S4. Grouting Construction of Shallow Grouting Zone 131

Within the influence range of advance abutment pressure zone 13, the surrounding rock of roadway 8 is gradually damaged from shallow to deep.

According to the detection results of roof fracture zone, the selective grouting construction is carried out to the grouting bolts entering the shallow grouting zone 131, so as to realize the reinforcement of the shallow surrounding rock of roadway.

S5. Grouting Construction of Deep Grouting Zone 132

As the working face continues to advance, grouting construction is carried out for the grouting cable 7 entering the deep grouting zone 132, and the grouting construction is carried out for the grouting bolt 6 entering the shallow grouting zone 131, so as to achieve the progressive reinforcement of the surrounding rock from shallow to deep, from the surface to the inside. The bolt-grouting range 16 and cable-grouting range 17 show in the FIG. 11.

Every time the working face 11 completes a cycle footage, repeat the above S1-S5.

The grouting construction in the above steps should be started in the maintenance team and completed as soon as possible to provide stable surrounding rock environment for the solidification of grouting materials.

In the embodiment of the invention, the inclinations of the four anchor plates 2 are the same, which is intentionally designed for the sake of beauty. In reality, the angles of anchor plates 2 are not necessarily the same. In addition, the grouting bolt-cable composite beam is mainly applicable to the roof conditions with large faults and a large number of rock fragments. In practice, selective grouting can be carried out according to the development degree of cracks in the roof. When the internal cracks of the roof are relatively developed and connected with each other, the number of bolt-grouting is 6-8. When the roof is complete and stable, and there are only a few tiny cracks and joints, the bolt-grouting number is 0-3.

The above is only a detail implementation of the invention, but the protection scope is not limited thereto. Any changes or substitutions without creative work shall be covered within the protection scope of the invention. Therefore, the protection scope of the invention should be limited by the protection scope as defined in the claims.

What is claimed is:

1. A grouting bolt-cable composite beam for advanced support of fractured surrounding rock in coal mines, which is characterized in that includes a steel beam, grouting cables, grouting bolts, quadrate plates, anchor plates, fastening nuts and an anchor rigging; the anchor plates are wedge-shaped blocks, upper and lower surfaces of each of the wedge-shaped blocks is a horizontal and an inclined plane with an anchor bolt hole arranged in the middle, an angle of each of the wedge-shaped blocks ensures that each of the grouting bolts is perpendicular to the inclined plane; connection relationship of the above components is as follows:

the quadrate plates are fixed at both ends of the steel beam, anchor cable holes are arranged in the center of the steel beam and the quadrate plates; there are four quadrate anchor bolt holes on each of the quadrate plates, and each of the quadrate anchor bolt holes corresponds to and is aligned to one of the anchor bolt holes of the anchor plates, horizontal surface of each of the anchor plates is close to one of the quadrate plates, and arc parts of four of the anchor plates are all facing center of the quadrate plates; each of the grouting bolt passes through one of the anchor bolt holes of one of the anchor plates and one of the quadrate anchor bolt holes of one of the quadrate plates, and is fixed in a roof by a first anchoring agent, and the free end of the bolt is applied with pretension through one of the fastening nuts; besides, each of the grouting cables passes through each of the anchor cable holes and is fixed in the overlying stable rock stratum by a second anchoring agent, and the free end of the cable is fixed by the anchor rigging.

2. The grouting bolt-cable composite beam for advanced support of fractured surrounding rock in the coal mines according to claim 1, which is characterized in that, wedge-shaped tips of the anchor plates are concave arc-shaped.

3. The grouting bolt-cable composite beam for advanced support of fractured surrounding rock in the coal mines according to claim 1, which is characterized in that, the anchor bolt holes on the quadrate plates are long round holes in order to adapt to boreholes with different inclinations.

4. The grouting bolt-cable composite beam for advanced support of fractured surrounding rock in the coal mines according to claim 1, wherein the grouting bolt-cable composite beam is used for supporting the fractured surrounding rock in the coal mines.

* * * * *